US010234225B2

(12) United States Patent
Zukowski et al.

(10) Patent No.: US 10,234,225 B2
(45) Date of Patent: Mar. 19, 2019

(54) MULTIPLE MODE DISCONNECTOR FOR PISTOLS

(71) Applicant: Smith & Wesson Corp., Springfield, MA (US)

(72) Inventors: Gary Zukowski, Ludlow, MA (US); Simon M. Muska, Enfield, CT (US)

(73) Assignee: Smith & Wesson Corp., Springfield, MA (US)

( * ) Notice: Subject to any disclaimer, the term of this patent is extended or adjusted under 35 U.S.C. 154(b) by 247 days.

(21) Appl. No.: 15/465,996

(22) Filed: Mar. 22, 2017

(65) Prior Publication Data

US 2018/0274872 A1 Sep. 27, 2018

(51) Int. Cl.
*F41C 3/00* (2006.01)
*F41A 17/20* (2006.01)

(52) U.S. Cl.
CPC ..... *F41A 17/20* (2013.01); *F41C 3/00* (2013.01)

(58) Field of Classification Search
CPC ..... F41A 17/20; F41A 17/22; F41A 17/24; F41A 17/26; F41A 17/28
See application file for complete search history.

(56) References Cited

U.S. PATENT DOCUMENTS 1,390,380 A * 9/1921 Pedersen ..... F41A 17/20 89/145
1,812,905 A * 7/1931 Stuyvesant ..... F41A 17/20 89/148
1,896,820 A 2/1933 Jolidon
2,140,946 A * 12/1938 Swartz ..... F41A 17/24 89/148
2,462,505 A * 2/1949 Kennedy ..... F41A 19/44 89/140
2,846,925 A * 8/1958 Norman ..... F41A 17/38 42/25
3,027,811 A 4/1962 Young
3,060,810 A 10/1962 Hillberg
3,109,345 A 11/1963 Norman
3,722,358 A * 3/1973 Seecamp ..... F41A 19/48 89/147
3,728,810 A 4/1973 Rohr
3,857,322 A 12/1974 Lichtman
3,857,325 A * 12/1974 Thomas ..... F41A 3/86 89/138
3,949,508 A 4/1976 Elkas
3,972,142 A 8/1976 Kawamura
4,017,996 A 4/1977 Liedke
(Continued)

*Primary Examiner* — Gabriel J. Klein
(74) *Attorney, Agent, or Firm* — John A. Chionchio, Esq.; Ballard Spahr LLP

(57) ABSTRACT

A disconnector for pistols having a trigger bar uses a body rotatably mounted on the pistol frame to permit or prevent engagement between the trigger bar and the pistol's sear. The body has a plurality of surfaces, one of which engages the trigger bar and pivots it between a safe orientation, out of alignment with the pistol's sear, and a fire orientation, aligned with the sear, when the body rotates between a safe position and a fire position. Another body surface engages the slide, the body being rotated into the safe position when the slide is out of battery. Another surface engages a grip safety and another surface engages a manual safety. Both safeties effect rotation of the body between the safe and fire positions when they are actuated.

17 Claims, 6 Drawing Sheets

(56) References Cited

U.S. PATENT DOCUMENTS

| | | | |
|---|---|---|---|
| 4,057,003 | A | 11/1977 | Atchisson |
| 4,409,882 | A | 10/1983 | Blackshaw et al. |
| 4,553,469 | A | 11/1985 | Atchisson |
| 4,706,401 | A | 11/1987 | Nielsen |
| 4,899,477 | A | 2/1990 | Aigner |
| 4,932,309 | A | 6/1990 | Barrett |
| 5,157,209 | A | 10/1992 | Dunn |
| 5,320,023 | A | 6/1994 | Erdem |
| 5,373,775 | A | 12/1994 | Findlay, Sr. et al. |
| 5,386,659 | A | 2/1995 | Vaid et al. |
| 5,697,178 | A | 12/1997 | Haskell |
| 5,939,657 | A | 8/1999 | Morgado |
| 6,412,206 | B1 | 7/2002 | Strayer |
| 6,634,129 | B1 | 10/2003 | Freeman, Jr. |
| 7,096,618 | B2 | 8/2006 | McGarry |
| 7,194,833 | B1 | 3/2007 | Curry |
| 7,810,268 | B1 | 10/2010 | McGarry |
| 8,601,932 | B1 | 12/2013 | Karfiol et al. |
| 9,057,574 | B2 | 6/2015 | McClave |
| 9,140,510 | B1 | 9/2015 | Muska |
| 2012/0096752 | A1 | 4/2012 | Lee |

* cited by examiner

FIG. 1
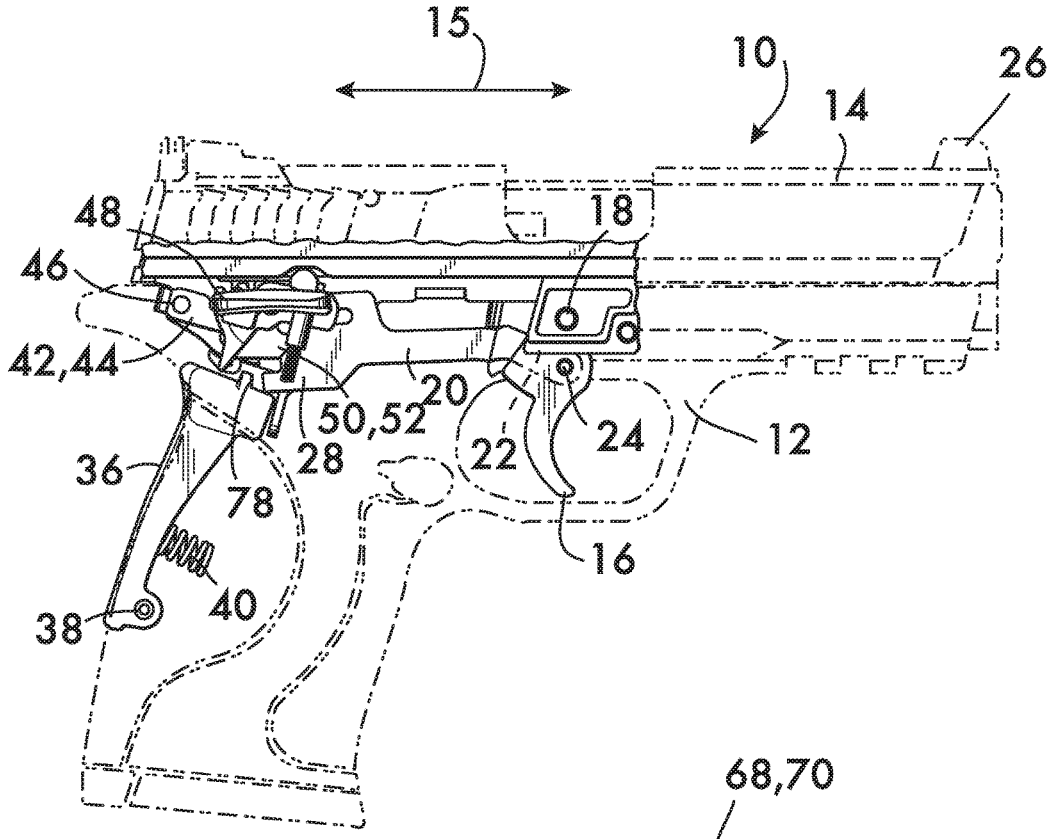
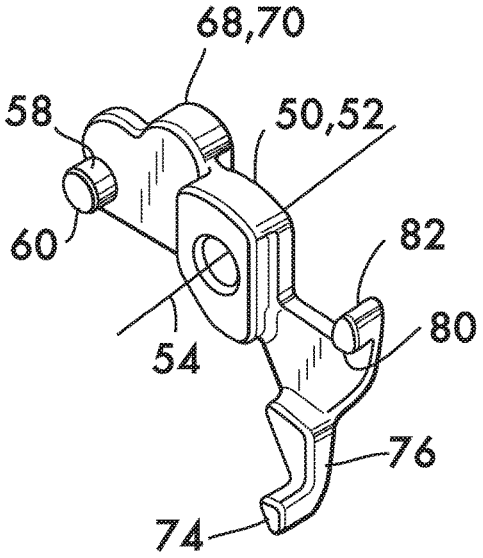
FIG. 2

MULTIPLE MODE DISCONNECTOR FOR PISTOLS

FIELD OF THE INVENTION

This invention relates to disconnector-type safety mechanisms for semiautomatic pistols.

BACKGROUND

Modern semiautomatic pistols may use a trigger bar between the trigger and the sear to effect motion of the sear to discharge the firearm when the trigger is pulled. In pistols employing trigger bars consideration must be given to the operation of safeties, such as grip safeties and manual safeties, the timing of sear reset during the firing cycle as well as prevention of firearm discharge when the pistol's slide is not fully closed (in battery). These considerations may be addressed to significant advantage using safety mechanisms which disconnect the trigger bar from the sear. In view of the inherent complexity occasioned by these various requirements there is clearly an opportunity to improve on the firing and safety mechanisms of pistols by increasing their reliability while simplifying their design.

SUMMARY

The invention concerns a pistol. In one example embodiment the pistol comprises a frame on which a slide, a trigger and a grip safety are moveably mounted. The grip safety is movable between a released position and a compressed position. A spring biases the grip safety into the released position. A sear is rotatably mounted on the frame. A trigger bar has a first end pivotably attached to the trigger and a second end oppositely disposed. A body is attached to the frame for rotation about an axis between a fire position and a safe position. A spring biases the body into the fire position. In one example embodiment the body comprises a first surface positioned in spaced relation to the axis. The first surface is engaged with the trigger bar for pivoting the trigger bar between a fire orientation, when the body rotates into the fire position, and a safe orientation, when the body rotates into the safe position. The second end of the trigger bar is not engageable with the sear when the trigger bar is in the safe orientation, the second end being engageable with the sear when the trigger bar is in the fire orientation. A second surface is positioned in spaced relation to the axis. The second surface is engageable with the slide upon motion of the slide out of battery. Engagement between the second surface and the slide rotates the body into the safe position. A third surface is positioned in spaced relation to the axis. The third surface is engaged with the grip safety when the grip safety is in the released position. Engagement between the grip safety and the third surface rotates the body into the safe position. Motion of the grip safety into the compressed position disengages the grip safety from the third surface and allows the body to rotate into the fire position.

By way of example, the first surface is positioned on a projection extending from the body. In a further example, a slot is positioned in the second end of the trigger bar. The projection extends from the body and engages the slot. In a specific example embodiment the trigger bar comprises a tab positioned at the second end thereof. The tab extends transversely to the trigger bar and is engageable with the sear in this example.

In a further example embodiment the slide comprises a cam surface facing the body. The cam surface extends lengthwise along the slide and has a notch therein. The second surface of the body comprises a cam follower engageable with the cam surface. The cam follower extends from the body and is received within the notch when the slide is in battery. The body is rotated into the safe position when the cam follower engages the cam surface, and the body is rotated into the fire position when the cam follower is received within the notch.

In an example embodiment the trigger is pivotably mounted on the frame. Further by way of example, the grip safety is pivotably mounted on the frame. In a specific example embodiment the grip safety comprises a projection extending therefrom and the third surface is positioned on a spur projecting from the body. The projection is engageable with the spur upon motion of the grip safety into the released position.

A further example embodiment comprises a safety, the safety comprising a lever pivotably mounted on the frame. An actuation surface extends from the lever for manual actuation of the lever between an on position and an off position. The body comprises a fourth surface positioned in spaced relation to the axis. The fourth surface is engaged with the lever. Pivoting of the lever into the on position rotates the body into the safe position, pivoting of the lever into the off position permits the body to rotate into the fire position. In a specific example embodiment the fourth surface comprises a projection extending from the body.

The invention also encompasses a disconnector for a pistol having a sear, a slide, a trigger, a trigger bar attached to the trigger and a grip safety. In an example embodiment the disconnector comprises a body attachable to the pistol for rotation about an axis between a fire position and a safe position. An example body comprises a first surface positioned in spaced relation to the axis. The first surface is engageable with the trigger bar for moving the trigger bar between a fire orientation when the body rotates into the fire position, and a safe orientation when the body rotates into the safe position. The trigger bar is not engageable with the sear when the trigger bar is in the safe orientation, the trigger bar is engageable with the sear when the trigger bar is in the fire orientation. A second surface is positioned in spaced relation to the axis. The second surface is engageable with the slide upon motion of the slide out of battery. Engagement between the second surface and the slide rotate the body into the safe position. A third surface is positioned in spaced relation to the axis. The third surface is engageable with the grip safety. Engagement between the grip safety and the third surface rotates the body into the safe position. Motion of the grip safety out of engagement with the third surface allows the body to rotate into the fire position.

In a specific example embodiment the first surface is positioned on a projection extending from the body. In a further example the projection is adapted to engage a slot positioned in the trigger bar. In an example embodiment the second surface of the body comprises a cam follower engageable with a cam surface extending lengthwise along the slide. The cam follower extends from the body and is received within a notch in the cam surface when the slide is in battery. The body is rotated into the safe position when the cam follower engages the cam surface, the body rotating into the fire position when the cam follower is received within the notch.

In a specific example embodiment the third surface is positioned on a spur projecting from the body. In another example embodiment the body further comprises a fourth surface positioned in spaced relation to the axis. The fourth surface is engageable with a safety lever pivotably mounted on the pistol. Pivoting of the safety lever into engagement with the fourth surface rotates the body into the safe position. In an example embodiment the fourth surface comprises a projection extending from the body.

BRIEF DESCRIPTION OF THE DRAWINGS

FIG. 1 is a partial cut-away side view of an example embodiment of a semiautomatic pistol according to the invention;

FIG. 2 is an isometric view of an example disconnector according to the invention used in the pistol shown in FIG. 1;

DETAILED DESCRIPTION

Figure 3:
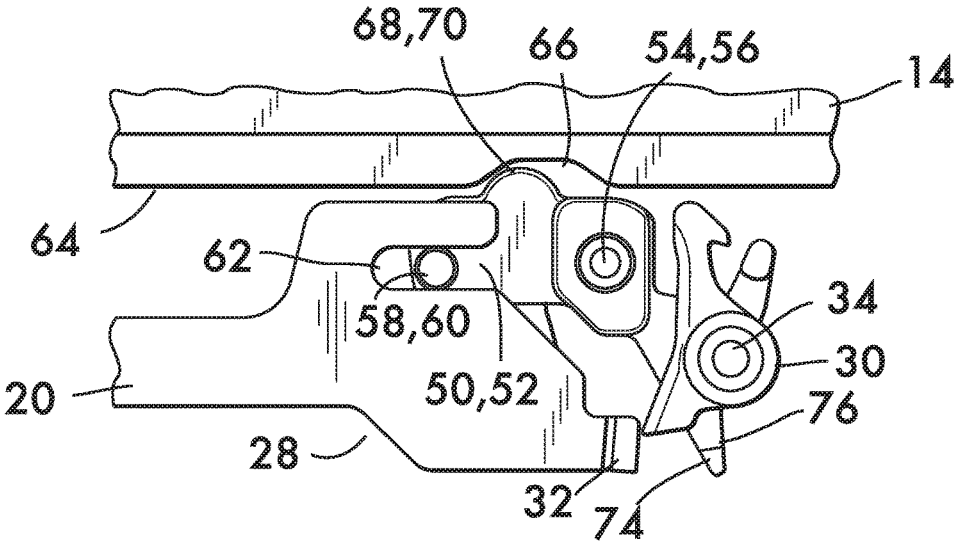
FIGS. 3 and 4 show a portion of the pistol which illustrates operation of the example disconnector with a trigger bar and sear of the pistol shown in FIG. 1.

FIG. 1 shows an example embodiment of a pistol 10 according to the invention. Pistol 10 comprises a frame 12 on which a slide 14 is movably mounted, the slide being movable along a line of action 15 between a "battery" position (shown) and a position "out of battery" (see FIG. 6). A trigger 16 is movably mounted on frame 12. In this example, trigger 16 pivots about pivot pin 18 supported on the frame 12. A trigger bar 20 has a first end 22 pivotably attached to trigger 16, the trigger bar pivoting about a bar pivot pin 24 extending through trigger 16. The attachment of the trigger bar 20 to trigger 16 is located relatively to the trigger pivot pin 18 such that when the trigger 16 pivots clockwise about pin 18 as it is pulled, the trigger bar 20 moves away from the muzzle end 26 of pistol 10. Trigger bar 20 has a second end 28 oppositely disposed from first end 22. As shown in FIG. 3, the second end 28 of trigger bar 20 (shown from the opposite side from FIG. 1) is engageable with a sear 30. Trigger bar 20 has a tab 32 in this example. The tab 32 is positioned at the second end 28 of trigger bar 20 and extends transversely thereto to provide engagement with the sear 30. Sear 30 is rotatably mounted on frame 12 and rotates counter clockwise about pin 34 when the trigger 16 is pulled and the second end 28 of the trigger bar 20 engages the sear.

As shown in FIG. 1, a grip safety 36 is movably mounted to frame 12. In the example shown, grip safety 36 is mounted for pivoting motion about a pin 38. The grip safety is movable between a "released" position, pivoted counterclockwise (shown in FIGS. 1 and 7), and a "compressed" position, pivoted clockwise (shown in FIG. 8). When in the released position the pistol 10 may not be fired by pulling trigger 16 as described below. A spring 40 acts between the frame 12 and the grip safety 36 and biases the grip safety into the released position. Pistol 10 also comprises a manual safety 42. In the example embodiment shown in FIGS. 1, 9 and 10 the manual safety 42 comprises a lever 44 pivotably attached to frame 12 via a pin 46. An actuation surface 48 extends from lever 44 and permits manual actuation of lever 44 between an "on" position (pivoted counterclockwise, FIG. 10) and an "off" position (pivoted clockwise, FIG. 9). When lever 44 is in the on position pistol 10 cannot be fired by pulling trigger 16 as described below.

Figure 4:
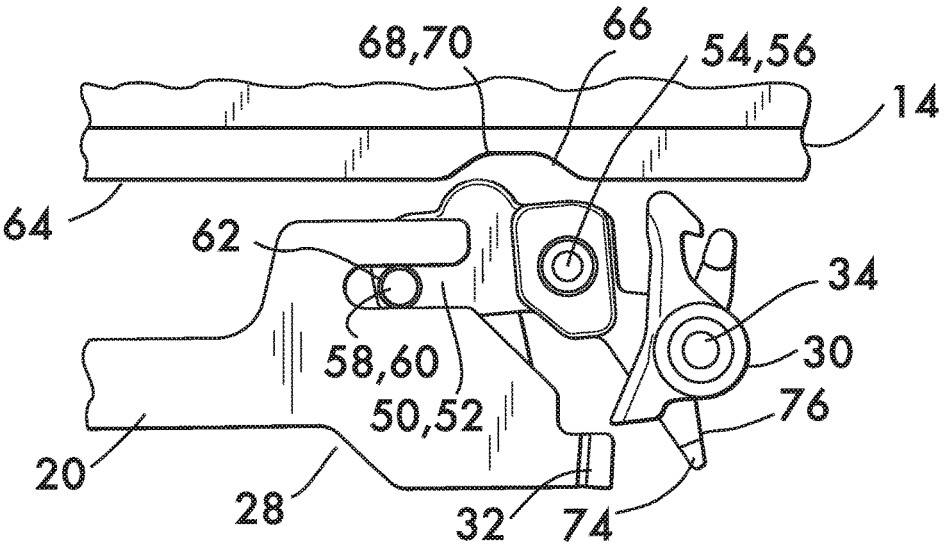

A disconnector 50, shown in FIGS. 1, 2 and 3, is rotatably mounted on frame 12. In the example embodiment shown, the disconnector comprises a body 52 rotatable about an axis 54 defined by a pin 56 supported on the frame 12. As shown in FIGS. 3 and 4, body 52 is rotatable between a "fire" position (FIG. 3) and a "safe" position (FIG. 4). As described below, body 52 interacts with slide 14, grip safety 36 and manual safety 42 to move the trigger bar 20 between a "fire" orientation (FIG. 3) where its second end 28 can engage sear 30, and a "safe" orientation (FIG. 4), where the second end 28 of trigger bar 20 cannot engage the sear.

Interaction between the body 52 and the trigger bar 20 is effected via a first surface 58 positioned in spaced relation to axis 54. In the example mechanism shown in FIG. 2, the first surface 58 is positioned on a projection 60 extending from body 52. As shown in FIGS. 3 and 4, projection 60 engages a slot 62 in the second end 28 of trigger bar 20. Slot 62 permits both pivoting and sliding motion of the trigger bar 20. Thus, when body 52 rotates clockwise into the fire position shown in FIG. 3, the geometry of the projection 60 relative to axis 54 is such that trigger bar 20 is pivoted into the fire orientation which positions the second end of trigger bar 20 (tab 32 in this example) so that it is aligned with and engageable with sear 30. The pistol may be discharged by pulling trigger 16, the projection 60 traversing slot 62 and permitting the trigger 16 to pivot and trigger bar 20 to slide toward and engage sear 30. However, the geometry of the projection 60 relative to axis 54 is such that when body 52 rotates counterclockwise into the safe position (FIG. 4), the projection 60, acting within the slot 62, pivots the trigger bar 20 into the safe orientation in which the second end 28 of trigger bar 20 passes astride the sear 30 when trigger 16 is pulled. Slot 62 will allow trigger 16 to be pulled, but this will not discharge pistol 10 because the sear 30 cannot be engaged; the trigger bar 20 is not aligned with the sear 30 when in the safe orientation.

Figure 5:
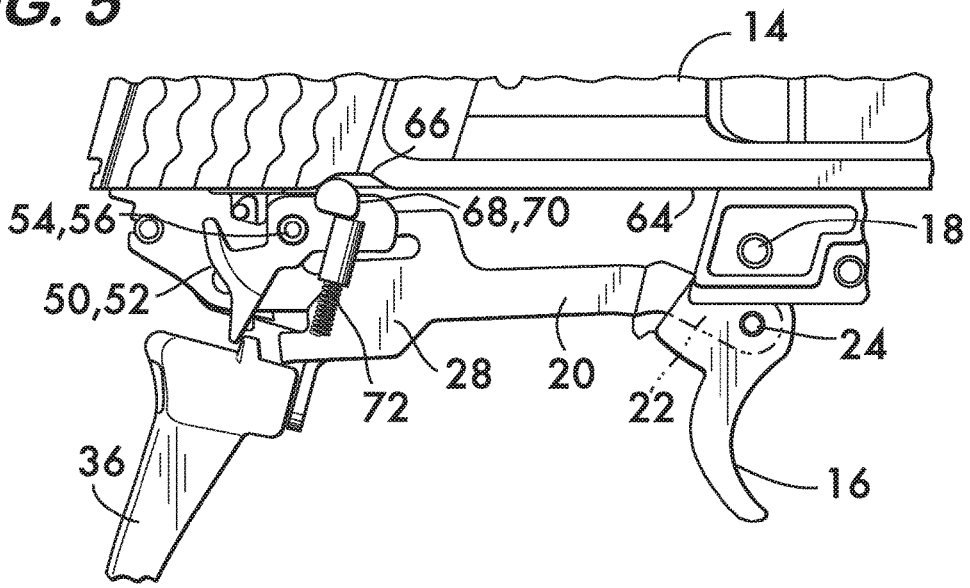
FIGS. 5 and 6 show a portion of the pistol which illustrates interaction between the pistol slide and the example disconnector.
Figure 6:
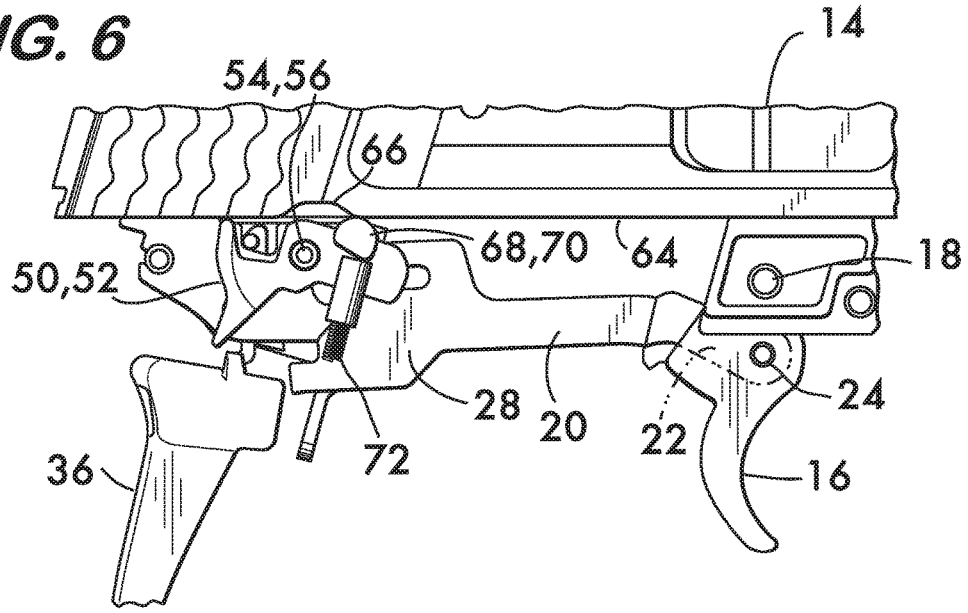

Interaction between the slide 14 and disconnector 50 is illustrated in FIGS. 5 and 6. FIG. 5 shows the slide 14 in battery, the slide having a cam surface 64 facing body 52. Cam surface 64 extends lengthwise along slide 14 but is interrupted by a notch 66. When slide 14 is in battery notch 66 is positioned to receive a second surface 68 on body 52 (see also FIG. 2). Second surface 68 is positioned in spaced relation to axis 54 and in this example takes the form of a cam follower 70 which extends from the body 52. When the cam follower is received in notch 66 the disconnector 50 (body 52) is in the fire position as shown in FIG. 5, and the trigger bar 20 is in the fire orientation shown in FIG. 3, the second end 28 of the trigger bar in alignment with sear 30. With the disconnector 50 in the fire position the pistol 10 may be fired by pulling trigger 16. However, when the slide 14 moves out of battery as shown in FIG. 6, the second surface 68 (cam follower 70) engages the cam surface 64 on the slide 14 and rotates the disconnector 50 into the safe position. Rotation of the disconnector 50 pivots the trigger bar 20 into the safe orientation (see FIG. 4), moving the second end 28 of the trigger bar out of alignment with the sear and preventing discharge of the firearm when trigger 16 is pulled. When the slide 14 returns to battery (FIG. 5) the disconnector 50 is rotated back into the fire position by a biasing spring 72 which operates between the frame 12 and the body 52.

Figure 7:
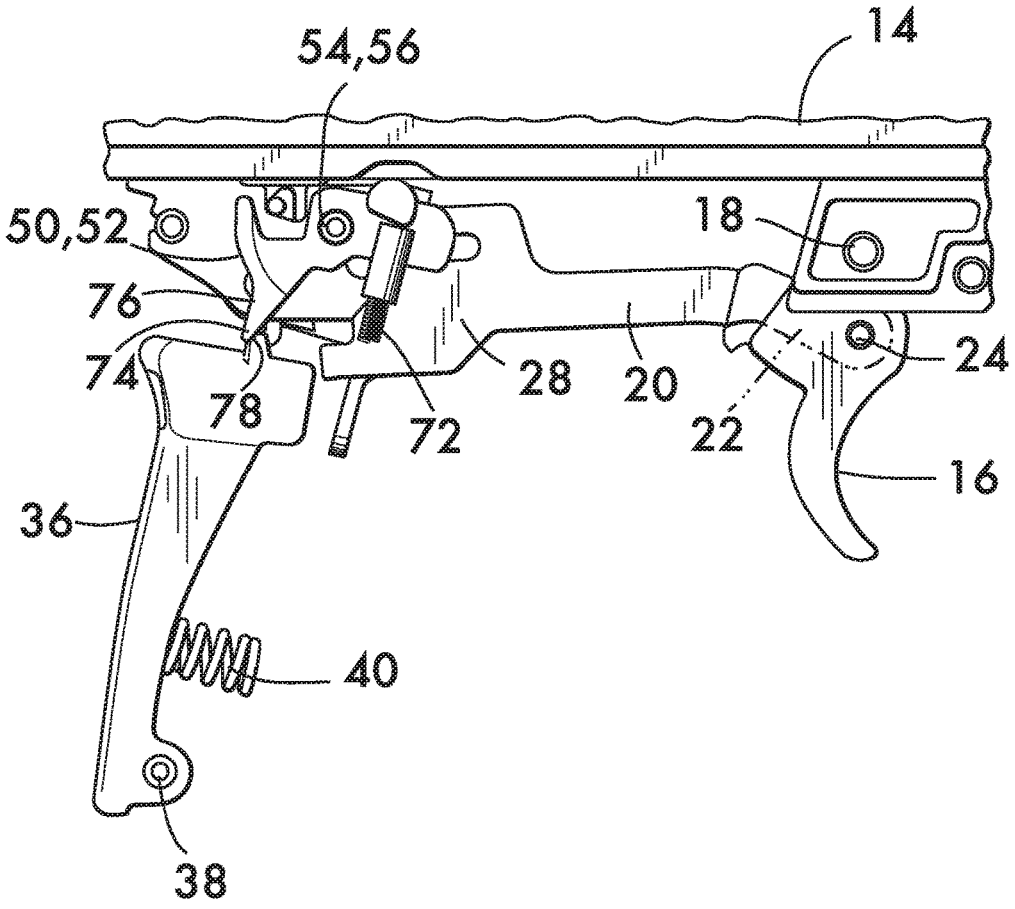
FIGS. 7 and 8 show a portion of the pistol which illustrates interaction between a grip safety and the example disconnector.
Figure 8:
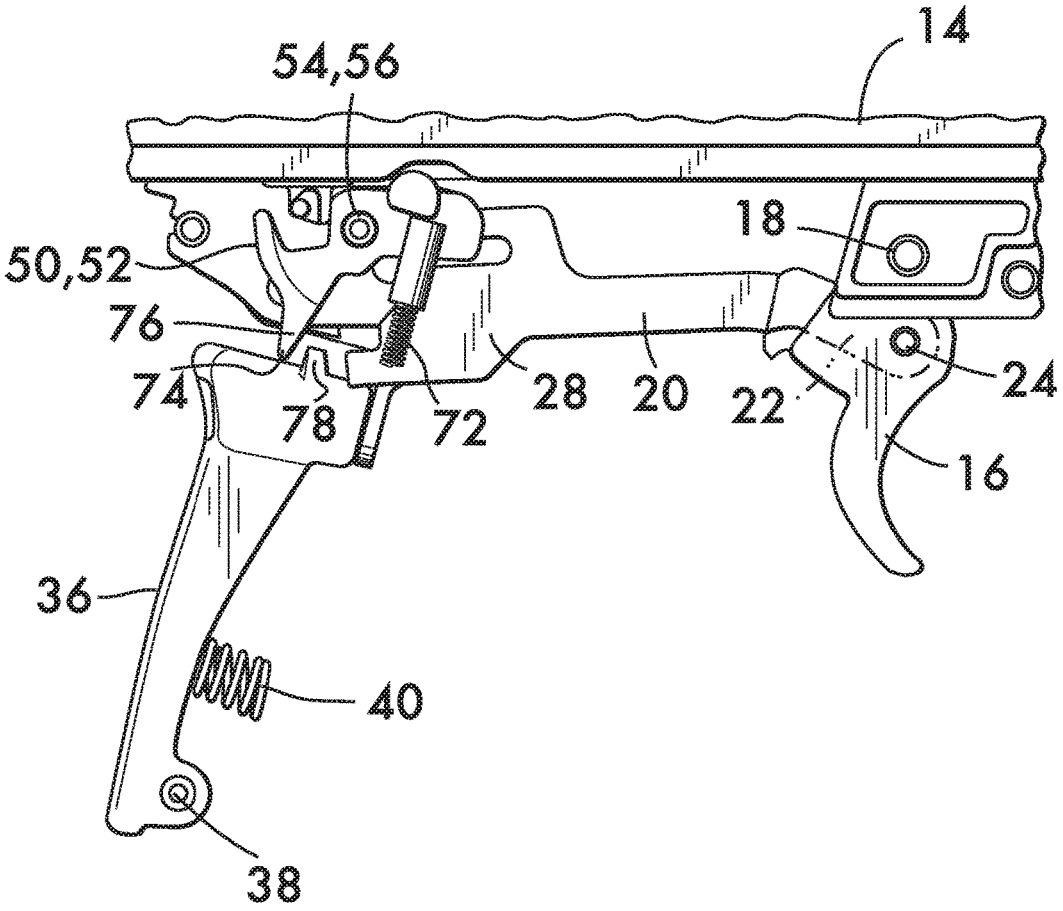

Interaction between the grip safety 36 and the disconnector 50 is illustrated in FIGS. 7 and 8. FIG. 7 shows the grip safety 36 in the released position where it is biased counterclockwise about pin 38 into engagement with a third surface 74 on body 52 (see also FIG. 2). In the example shown the third surface 74 is positioned on a spur 76 extending from the body 52 to position it in spaced relation to the axis 54. When the grip safety is in the released position it engages the spur 76 and rotates the body 52 into the safe position (FIG. 4). In this example a projection 78 extends from the grip safety to engage the spur 76. With the body 52 in the safe position the pistol cannot be fired by pulling trigger 16, as the trigger bar 20 is in the safe orientation shown in FIG. 4 and not aligned with sear 30. However, when the pistol 10 is gripped by a shooter the grip safety is pivoted clockwise into the compressed position shown in FIG. 8. Clockwise pivoting of the grip safety 36 disengages the projection 78 from the spur 76 and permits the disconnector 50 (body 52) to rotate into the fire position (provided the slide 14 is in battery), biased by its spring 72. Consequently, the trigger bar 20 pivots into the fire orientation (FIG. 3) and the pistol 10 may be fired by pulling trigger 16.

Figure 9:
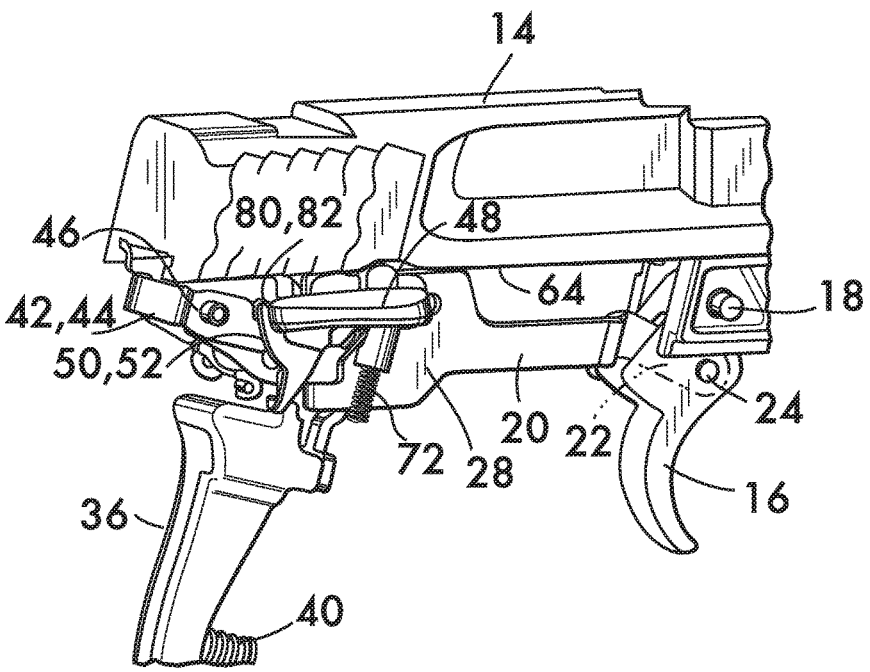
FIGS. 9 and 10 show a portion of the pistol which illustrates interaction between a manual safety and the example disconnector.
Figure 10:
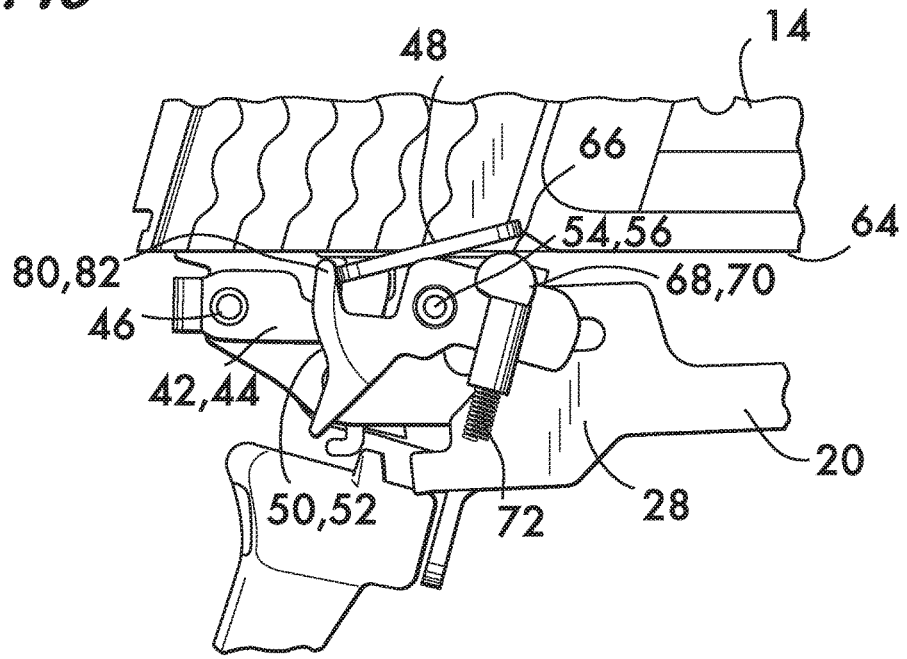

FIGS. 9 and 10 illustrate interaction between the manual safety 42 and the disconnector 50. A fourth surface 80 is positioned on body 52 in spaced relation to axis 54. In this example the fourth surface 80 is positioned on a projection 82 extending from body 52 (see FIG. 2). The fourth surface 80 is engaged with lever 44 of the manual safety 42. Pivoting of lever 44 into the off position as shown in FIG. 9 permits the body 52 to rotate into the fire position (provided the slide 14 is in battery), biased by spring 72. The trigger bar 20 is thus pivoted into the fire orientation aligned with sear 30 (FIG. 3) and the pistol 10 may be fired by pulling trigger 16. However, if the lever 44 is pivoted counterclockwise into the on position as shown in FIG. 10, engagement between the fourth surface 80 on projection 82 and the lever 44 rotates the body 52 clockwise as viewed in FIG. 10 and into the safe position, thereby pivoting the trigger bar 20 into the safe orientation (FIG. 4) out of alignment with the sear 30 and thus preventing the pistol 10 from being fired by pulling trigger 16.

Pistols employing the multi-mode disconnector according to the invention are expected to operate more reliably and safely with fewer moving parts than prior art firearms. The following additional advantages are also anticipated. Because the mechanism disconnects the trigger from the sear, various parts (the disconnector and the trigger bar for example) can be lighter and smaller when compared with safety mechanisms which block motion, and thus must withstand greater stress when in operation. The various modes of the disconnector according to the invention act independently from one another, thereby manifesting modularity which enables any combination of safety features—grip safety, manual safety and slide safety—to be incorporated into a pistol.

What is claimed is:

1. A pistol, said pistol comprising:

a frame on which a slide, a trigger and a grip safety are moveably mounted, said grip safety being movable between a released position and a compressed position, a spring biasing said grip safety into said released position;

a sear rotatably mounted on said frame;

a trigger bar having a first end pivotably attached to said trigger and a second end oppositely disposed;

a body attached to said frame for rotation about an axis between a fire position and a safe position, a spring biasing said body into said fire position, said body comprising:

a first surface positioned in spaced relation to said axis, said first surface being engaged with said trigger bar for pivoting said trigger bar between a fire orientation when said body rotates into said fire position, and a safe orientation when said body rotates into said safe position, wherein said second end of said trigger bar is not engageable with said sear when said trigger bar is in said safe orientation, said second end being engageable with said sear when said trigger bar is in said fire orientation;

a second surface positioned in spaced relation to said axis, said second surface being engageable with said slide upon motion of said slide out of battery, engagement between said second surface and said slide rotating said body into said safe position;

a third surface positioned in spaced relation to said axis, said third surface being engaged with said grip safety when said grip safety is in said released position, engagement between said grip safety and said third surface rotating said body into said safe position, motion of said grip safety into said compressed position disengaging said grip safety from said third surface and allowing said body to rotate into said fire position.

2. The pistol according to claim 1, wherein said first surface is positioned on a projection extending from said body.

3. The pistol according to claim 2, further comprising a slot positioned in said second end of said trigger bar, said projection extending from said body engaging said slot.

4. The pistol according to claim 1, wherein said trigger bar comprises a tab positioned at said second end thereof, said tab extending transversely to said trigger bar and being engageable with said sear.

5. The pistol according to claim 1, wherein:

said slide comprises a cam surface facing said body, said cam surface extending lengthwise along said slide and having a notch therein;

said second surface of said body comprises a cam follower engageable with said cam surface, said cam follower extending from said body and being received within said notch when said slide is in battery, said body being rotated into said safe position when said cam follower engages said cam surface, said body rotating into said fire position when said cam follower is received within said notch.

6. The pistol according to claim 1, wherein said trigger is pivotably mounted on said frame.

7. The pistol according to claim 1, wherein said grip safety is pivotably mounted on said frame.

8. The pistol according to claim 1, wherein said grip safety comprises a projection extending therefrom and said third surface is positioned on a spur projecting from said body, said projection being engageable with said spur upon motion of said grip safety into said released position.

9. The pistol according to claim 1, further comprising a safety, said safety comprising:

a lever pivotably mounted on said frame;

an actuation surface extending from said lever for manual actuation of said lever between an on position and an off position;

said body comprising a fourth surface positioned in spaced relation to said axis, said fourth surface being engaged with said lever; wherein pivoting of said lever into said on position rotates said body into said safe position, pivoting of said lever into said off position permitting said body to rotate into said fire position.

10. The pistol according to claim 9, wherein said fourth surface comprises a projection extending from said body.

11. A disconnector for a pistol having a sear, a slide, a trigger, a trigger bar attached to said trigger and a grip safety, said disconnector comprising:

a body attachable to said pistol for rotation about an axis between a fire position and a safe position, said body comprising:

a first surface positioned in spaced relation to said axis, said first surface being engageable with said trigger bar for moving said trigger bar between a fire orientation when said body rotates into said fire position, and a safe orientation when said body rotates into said safe position, wherein said trigger bar is not engageable with said sear when said trigger bar is in said safe orientation, said trigger bar being engageable with said sear when said trigger bar is in said fire orientation;

a second surface positioned in spaced relation to said axis, said second surface being engageable with said slide upon motion of said slide out of battery, engagement between said second surface and said slide rotating said body into said safe position;

a third surface positioned in spaced relation to said axis, said third surface being engageable with said grip safety, engagement between said grip safety and said third surface rotating said body into said safe position, motion of said grip safety out of engagement with said third surface allowing said body to rotate into said fire position.

12. The disconnector according to claim 11, wherein said first surface is positioned on a projection extending from said body.

13. The disconnector according to claim 12, wherein said projection is adapted to engage a slot positioned in said trigger bar.

14. The disconnector according to claim 1, wherein said second surface of said body comprises a cam follower engageable with a cam surface extending lengthwise along said slide, said cam follower extending from said body and being received within a notch in said cam surface when said slide is in battery, said body being rotated into said safe position when said cam follower engages said cam surface, said body rotating into said fire position when said cam follower is received within said notch.

15. The disconnector according to claim 11, wherein said third surface is positioned on a spur projecting from said body.

16. The disconnector according to claim 11, said body further comprising:

a fourth surface positioned in spaced relation to said axis, said fourth surface being engageable with a safety lever pivotably mounted on said pistol; wherein pivoting of said safety lever into engagement with said fourth surface rotates said body into said safe position.

17. The disconnector according to claim 16, wherein said fourth surface comprises a projection extending from said body.

* * * * *